US006396017B1

(12) United States Patent
Knickrehm

(10) Patent No.: US 6,396,017 B1
(45) Date of Patent: May 28, 2002

(54) METHOD OF AND APPARATUS FOR MONITORING THE OUTLINES OF FINISHED CONTAINERS

(75) Inventor: Robert Knickrehm, Rethwisch (DE)

(73) Assignee: Topack Verpackungstechnik GmbH (DE)

( * ) Notice: Subject to any disclaimer, the term of this patent is extended or adjusted under 35 U.S.C. 154(b) by 0 days.

(21) Appl. No.: 09/666,427

(22) Filed: Sep. 21, 2000

(30) Foreign Application Priority Data

Sep. 30, 1999 (DE) ..... 199 46 932

(51) Int. Cl.[7] ..... B07B 5/00

(52) U.S. Cl. ..... 209/536; 209/535; 209/537; 250/223 R; 356/435

(58) Field of Search ..... 209/535, 536, 209/577, 597, 598; 250/223 R; 356/432, 433, 435

(56) References Cited

U.S. PATENT DOCUMENTS

| | | | | | |
|---|---|---|---|---|---|
| 3,603,457 | A | * | 9/1971 | Flodin | 209/82 |
| 3,939,984 | A | | 2/1976 | Butner et al. | 209/74 M |
| 3,956,110 | A | * | 5/1976 | Seragnoli | 209/82 |
| 4,011,950 | A | * | 3/1977 | McLoughlin et al. | 209/73 |
| 4,813,288 | A | | 3/1989 | Gamberini | |
| 4,879,752 | A | * | 11/1989 | Aune et al. | 382/1 |
| 4,963,035 | A | * | 10/1990 | McCarthy et al. | 382/28 |
| 4,972,494 | A | | 11/1990 | White et al. | |
| 5,142,159 | A | * | 8/1992 | Veit et al. | 250/560 |
| 5,240,117 | A | | 8/1993 | Focke et al. | |
| 5,326,311 | A | * | 7/1994 | Persoon et al. | 452/184 |

FOREIGN PATENT DOCUMENTS

| | | | |
|---|---|---|---|
| DE | 3523208 | 1/1986 | B65B/57/00 |
| DE | 3700928 | 7/1987 | B65B/57/00 |
| DE | 19607215 | 8/1997 | B65B/57/02 |
| DE | 19743984 | 4/1999 | B65B/57/02 |
| DE | 198 39 852 | 9/1999 | |

* cited by examiner

*Primary Examiner*—Christopher P. Ellis
*Assistant Examiner*—Mark J Beauchaine
(74) *Attorney, Agent, or Firm*—Venable; George H. Spencer; Robert Kinberg

(57) ABSTRACT

Successive packets of cigarettes or the like are monitored to ascertain the integrity or absence of integrity of their outer envelopes by conveying them across at least one curtain of radiation so that a packet having an improperly glued flap or tuck or label or an analogous defect affecting the acceptability of its outline intercepts a greater amount of radiation than a packet having an outline matching that of a prototype. First signals denoting the amount of radiation intercepted by successive packets are compared with a reference signal denoting the amount of radiation intercepted by the prototype and, when the difference between a first signal and the reference signal is outside of a permissible range, the corresponding packet is segregated from other packets.

21 Claims, 5 Drawing Sheets

METHOD OF AND APPARATUS FOR MONITORING THE OUTLINES OF FINISHED CONTAINERS

CROSS-REFERENCE TO RELATED CASES

This application claims the priority of commonly owned German patent application Serial No. 199 46 932.6 filed Sep. 30, 1999. The disclosure of the above-referenced German patent application, as well as that of each U.S. and foreign patent and patent application mentioned in the specification of the present application, is incorporated herein by reference.

BACKGROUND OF THE INVENTION

The invention relates to improvements in methods of and in apparatus for testing successive commodities (such as box-shaped containers, especially so-called packets containing smokers' products) of short or long series of such commodities. For example, the testing apparatus of the present invention can be utilized in a production line which turns out so-called soft packets or so-called hinged-lid packets of plain or filter cigarettes. More specifically, the invention relates to improvements in methods of and in apparatus for ascertaining the outlines or shapes of cigarette packets or analogous commodities and for ascertaining the presence or absence of departures of the outlines of successive commodities from a predetermined (desirable or optimum) outlines.

It is customary to make the envelopes of cigarette packets from several layers including a cardboard layer, at least one paper layer, at least one metallic layer (such as a layer made of tinfoil or aluminum foil), and an outermost layer of transparent or translucent plastic material. One or more layers are normally obtained by draping a prefabricated blank around the array of cigarettes or around a finished inner envelope; this results in the development of flaps, tucks, panels and/or other projecting parts which are normally glued or heat-sealed to the adjacent layer of the respective converted blank. It happens, from time to time, that the projecting parts are not glued, or are not adequately glued, to the adjacent portions of the respective converted blanks, and this can cause problems, for example, if an array of say ten cigarette packets is to be introduced into a so-called carton.

It also happens at times that a flap or tuck or panel is not properly positioned relative to the neighboring part or parts of an envelope forming part of a cigarette packet or an analogous commodity, i.e., the panel, tuck or flap can be glued to the adjacent part of an envelope but not in proper position so that a portion thereof projects beyond the outline of the packet. This detracts from the appearance of the finished packet. Still further, it is desirable to ensure that the revenue label and/or an adhesive-coated finished patch or stamp be properly applied to a selected side (such as the underside) of the finished cigarette packet.

The monitoring of successive packets of cigarettes or other smokers' products must be carried out at a high frequency because a modern production line normally turns out huge quantities of plain or filter cigarettes, cigars, cigarillos or other rod-shaped smokers' products. Moreover, the testing of successive packets to determine the presence or absence of one or more flaps, panels, tucks, labels, stamps or like which protrude beyond the prescribed outline of the commodity must be carried out with a high degree of reliability, i.e., each commodity which does not exhibit a desired or required outline must be segregated from other commodities without fail even if such testing must be carried at a high or very high frequency.

OBJECTS OF THE INVENTION

An object of the present invention is to provide a novel and improved method of monitoring block-shaped or other types of commodities, such as cigarette packets, for the presence or absence of protruding panels, flaps, tucks, stamps, labels and/or other sheet-like parts.

Another object of the invention is to provide a method which can be practiced to simultaneously monitor successive commodities from several sides or directions so that eventually existing protruding flaps or the like and/or other deformities of the commodities which cannot be detected during an examination of a single side are, or are more likely to be, detected in accordance with the improved method.

A further object of the invention is to provide a method which involves gentle treatment of successive commodities so that the practice of the method does not entail any damage to (such as defacing or deformation of) the tested commodities.

An additional object of the present invention is to provide a novel and improved apparatus for the practice of the above outlined method.

Still another object of the invention is to provide an apparatus which is capable of carrying out a plurality of simultaneous tests and which can segregate (preferably automatically) defective commodities from satisfactory commodities.

A further object of the invention is to provide an apparatus which can be utilized with particular advantage in production lines which are designed to turn out soft or hinged-lid packets of plain or filter cigarettes or other rod-shaped smokers' products.

Another object of the invention is to provide a novel and improved circuitry which can be utilized in the above outlined apparatus.

SUMMARY OF THE INVENTION

One feature of the present invention resides in the provision of a method of ascertaining the presence or absence of departures or deviations of the outlines or contours or shapes of successive normally identical commodities from a predetermined outline, contour or shape (hereinafter referred to as outline). For example, the commodities can constitute containers (such as rectangular parallelepipeds typical examples of which are packets containing arrays of rod-shaped smokers' products). The method comprises the steps of advancing successive commodities of a short or long or continuous series of equidistant or randomly spaced-apart commodities along a predetermined path (e.g., by the horizontal upper reach or stretch of an endless belt, band or chain conveyor) in a predetermined direction, establishing at least one curtain of radiation (e.g., a vertical curtain of radiation which propagates itself downwardly) across a predetermined portion of the path so that successive commodities advancing along the aforementioned portion of the path intercept amounts of radiation commensurate with (i.e., reflecting or indicative of) their outlines, and removing from the path each commodity which intercepts an amount of radiation departing from a predetermined amount which is indicative of the aforementioned predetermined outline (such as the outline of a commodity or prototype having an ideal or desired or optimum outline).

In accordance with a presently preferred embodiment of the method, the removing step includes generating first signals (such as electric signals) which denote the amounts of radiation intercepted by successive commodities during advancement along the predetermined portion of the path (such signals are indicative of the actual or ascertained outlines of the respective commodities), generating a reference signal which denotes the amount of radiation intercepted by a commodity (such as the aforementioned prototype) having the predetermined outline, and comparing each first signal with the reference signal to thus ascertain the extent of deviation of the first signal from the reference signal, i.e., to ascertain the extent of deviation of the outlines of successively monitored commodities from an ideal or optimum outline.

The establishing step can include establishing or providing a single curtain or a plurality of discrete curtains, for example, two coplanar curtains having identical or different widths. Each of the plurality of (e.g., two) discrete curtains preferably extends across the predetermined portion of the path in a position such that it is at least partially intercepted by successive commodities having the predetermined outline (provided, of course, that the commodities are properly oriented during advancement along the predetermined portion of the path, e.g., that successive commodities form a row or file of commodities having identical orientations relative to the advancing means).

As already mentioned hereinbefore, the advancing step can include moving successive commodities along an at least substantially horizontal path, and the at least one curtain (or two or more coplanar curtains) can be located in an at least substantially vertical plane crossing the predetermined portion of the path.

If the commodities are containers (such as packets for arrays of plain or filter cigarettes), they can include portions (such as panels, flaps, tucks, labels and/or stamps) which assume first positions when the outlines of such commodities at least approximate the predetermined outline (normally, such portions lie flat against the adjacent portions of the container). However, such portions of the containers assume second positions (e.g., they can extend away from the adjacent portions of the container) when the outlines of the commodities (contaners) depart from the predetermined or optimal outline. Such improper positioning of portions of the containers can be attributable to the application of insufficient quantities of glue, to non-uniform application of glue, to insufficient heating or cooling (i.e., to inadequate setting) of the glue, to improper creasing of the blanks of which the layers of the containers are made and/or to other defects of the blanks and/or improper manipulation of the blanks.

In addition to the basic (advancing, curtain establishing and removing) steps, the improved method can further comprise the steps of ascertaining the amounts of radiation intercepted by successive commodities in the predetermined portion of the path, generating first signals denoting the intercepted amounts of radiation, and comparing the first signals with a reference signal denoting the predetermined amount of radiation. The removing step of such method can include diverting from the predetermined path those commodities which, during advancement along the predetermined portion of the path, initiate the generation of first signals departing from the reference signal.

The establishing step of such method can include establishing a plurality of discrete curtains each of which extends across the predetermined portion of the path in a position such that it is at least partially intercepted by successive commodities having an outline at least approximating the predetermined outline. In accordance with such method, each of the first signals denotes the sum of radiations intercepted by the respective commodities advancing along the predetermined portion of the path.

The improved apparatus is designed to practice the above outlined method, i.e., to ascertain the presence and absence of departures of the outlines of commodities from a predetermined outline. The apparatus comprises means (such as an endless belt, band or chain conveyor) for advancing successive commodities along a predetermined path (e.g., an at least substantially horizontal path), means for establishing at least one curtain of radiation (e.g., a curtain which is disposed in a vertical plane) across a predetermined portion of the path so that successive commodities which advance along the predetermined portion of the path intercept amounts of radiation commensurate with (i.e., indicative of) their outlines, and means for comparing the intercepted amounts of radiation with a predetermined amount denoting the amount which would be intercepted by a prototype commodity having an outline at least approximating the predetermined outline.

The means for establishing at least one curtain of radiation can comprise at least one source of radiation (such as a light source) at one side of the predetermined portion of the path, and the means for comparing can comprise at least one receiver of radiation at another side of the predetermined portion of the path at least substantially opposite the one side.

More specifically, the means for comparing can comprise means for generating successive first signals having characteristics (such as intensities) denoting the amounts of radiation intercepted by successive commodities advancing along the predetermined portion of the path, means for establishing and maintaining a reference signal having characteristics which are indicative of the amount of radiation which is intercepted or which would be intercepted by the prototype commodity, and means for generating third signals which denote differences between successive first signals and the reference signal. The apparatus preferably further comprises means for (preferably automatically) removing from the predetermined path those commodities which initiate the generation of third signals denoting differences (between first signals and the reference signal) which are outside of a predetermined range of (acceptable) differences.

The signals are or can be electric signals.

The means for establishing at least one curtain of radiation can include a single radiation source which is arranged to emit a single curtain of radiation; the width of such single curtain can equal or exceed the width of the path and should exceed the width of the prototype commodity.

The means for establishing at least one curtain of radiation can include a plurality of radiation sources which are disposed at one side of the predetermined portion of the path and are arranged to establish discrete parallel (preferably coplanar) curtains of radiation, and such apparatus preferably comprises a plurality of receivers of radiation (one for each source) disposed at another side of the predetermined portion of the path opposite the one side. If the path is a substantially horizontal linear path, the radiation sources can be disposed at a level above the predetermined portion of the path and the receivers are or can be disposed at a level below such predetermined portion of the path.

The novel features which are considered as characteristic of the invention are set forth in particular in the appended claims. The improved apparatus itself, however, both as to its construction and the modes of assembling and utilizing the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
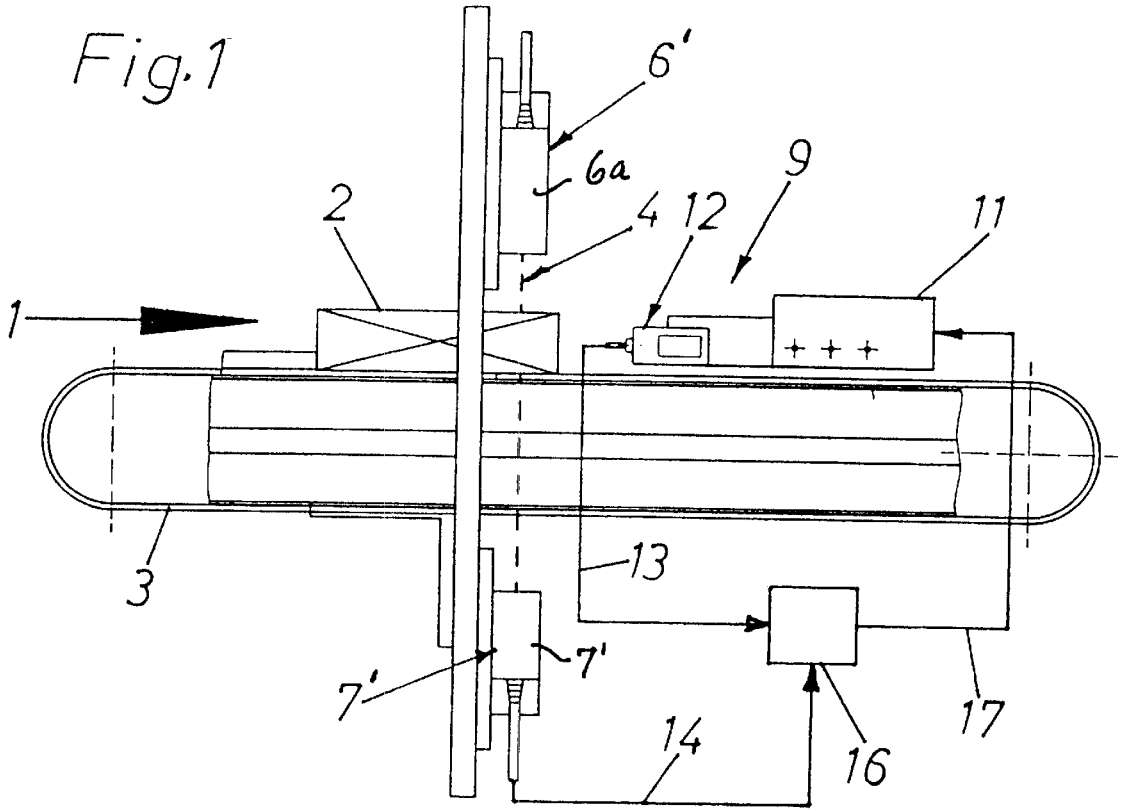
FIG. 1 is a schematic side elevational view of an apparatus which embodies one form of the present invention.
Figure 2:
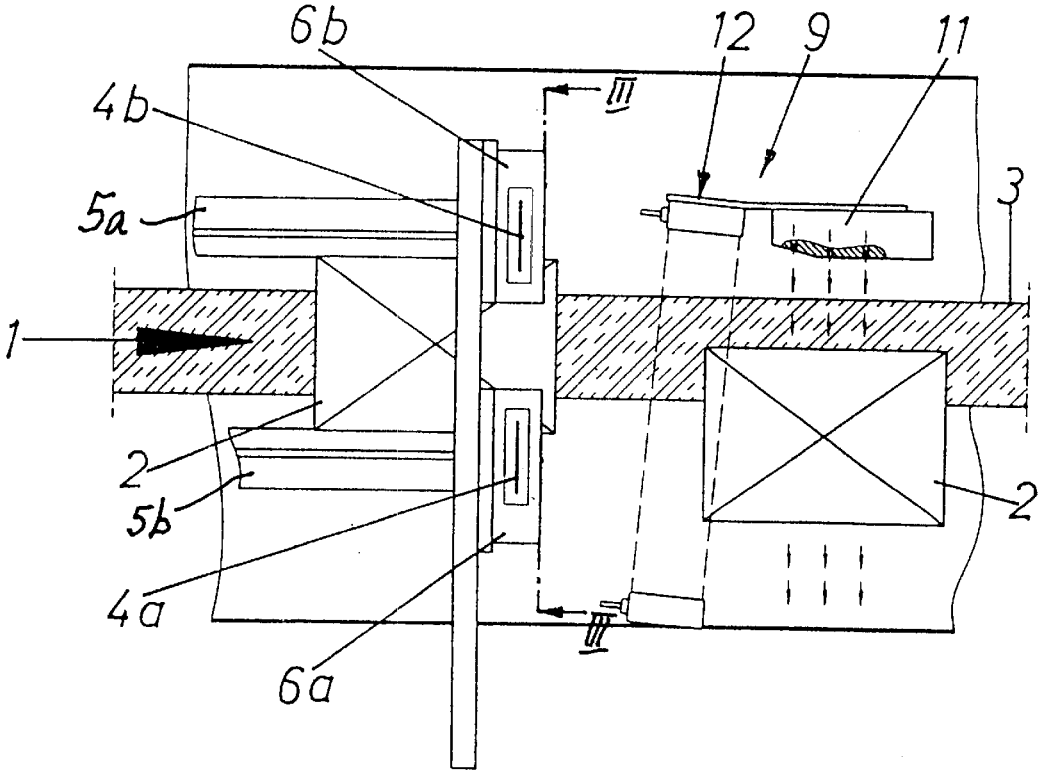
FIG. 2 is a plan view of the apparatus which is shown in FIG. 1.
Figure 3:
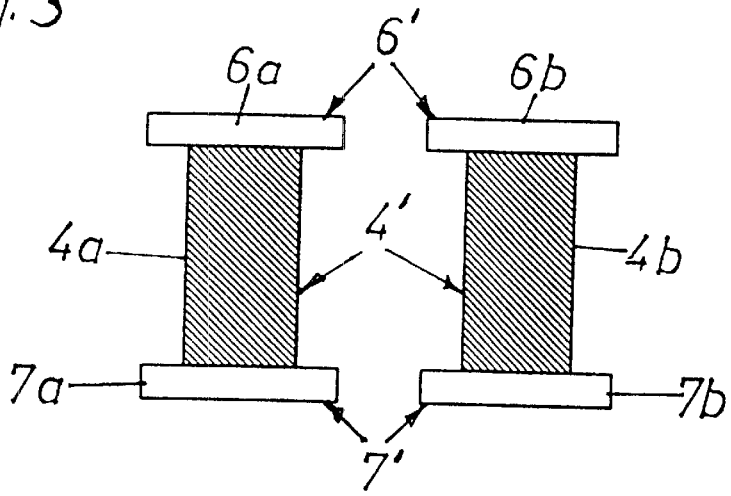
FIG. 3 is a front elevational view of that part of the apparatus of FIGS. 1 and 2 which serves to establish a two-part curtain of radiation across a portion of the path for successive commodities to be tested, the view of FIG. 3 being taken in the direction of arrows as seen from the line III—III in FIG. 2.
Figure 4:
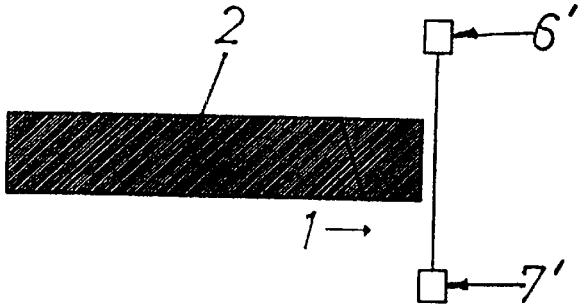
FIG. 4 is a side elevational view of the structure which is illustrated in FIG. 3 and further shows an acceptable block-shaped commodity on its way toward the two-part curtain of radiation.

Referring first to FIGS. 1 and 2, there is shown an apparatus which comprises an endless belt, band or chain conveyor 3 having a horizontal (or substantially horizontal) upper reach or stretch serving to advance a series of successive block-shaped commodities 2 along an elongated straight (linear) path in the direction indicated by an arrow 1. The commodities are assumed to be so-called soft or so-called hinged-lid packets having containers accommodating arrays of plain or filter cigarettes or other rod-shaped articles of the tobacco processing industry. For example, each commodity 2 (hereinafter called packet or cigarette packet) can confine an array of twenty cigarettes in the customary quincunx formation (including two parallel outer layers of seven cigarettes each and a median layer of six cigarettes which are staggered sideways with reference to the adjacent cigarettes of the two outer layers). Each block-shaped commodity or packet 2 can further comprise a hinged-lid cardboard box which confines a rectangular parallelepiped inner envelope consisting of or containing-metallic foil (such as aluminum foil or tinfoil) and directly surrounding the array of cigarettes as well as at least one outer envelope surrounding the cardboard box. For example, the outer envelope can be made of paper or cellophane and may but need not be provided with a customary tear strip.

The path for successive packets 2 is located at a level below a radiation source which serves to establish a one-piece curtain 4 of radiation (see the one-piece radiation source 6 shown in FIGS. 7, 8, 9*a*, 9*b*, 10*a* and 10*b*) or a plurality of discrete preferably coplanar curtains 4' (FIGS. 3, 5*a*, 5*b*, 6*a* and 6*b* show a composite radiation source 6' including two sections 6*a*, 6*b* serving to establish two discrete curtains 4*a* and 4*b*). The radiation of the single curtain 6 propagates itself toward and against a single receiver 7, and the radiation of the composite curtain 4*a*, 4*b* propagates itself toward a composite receiver 7'. The source 6 or 6' and the receiver 7 or 7' form parts of a photoelectric cell of any suitable design, for example, of the type known as Series LX2 and distributed by the German Firm Keyence Deutshland GmbH.

Figure 5A:
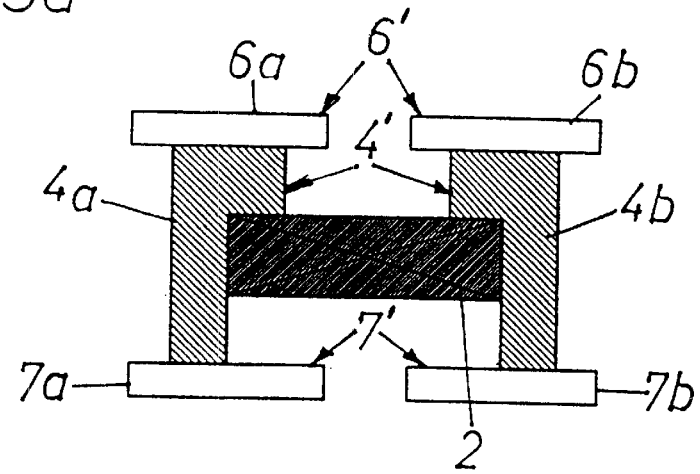
FIG. 5*a* is a view similar to that of FIG. 3 but showing the commodity of FIG. 4 in the process of intercepting portions of the two curtains of radiation.
Figure 5B:
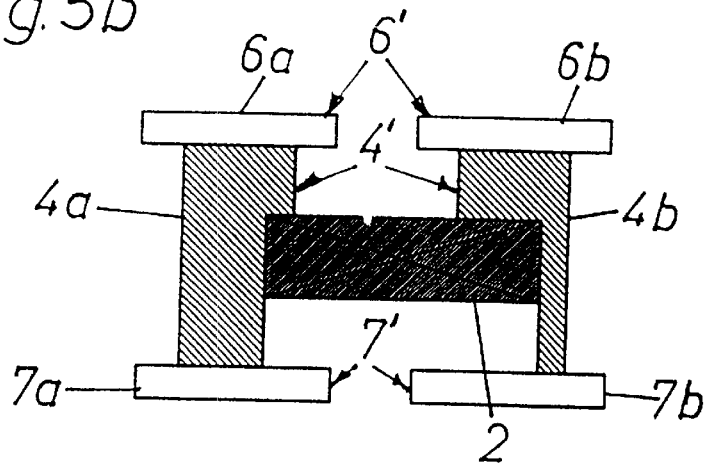
FIG. 5*b* is a view identical to that of FIG. 5*a* but with the acceptable commodity laterally offset relative to the acceptable commodity shown in FIG. 5*a;*

As shown in FIG. 5*a*, when an oncoming satisfactory packet 2 (namely a packet having an outline which is identical with or sufficiently close to a predetermined optimal or prescribed outline) intercepts a prescribed amount of radiation, it can intercept a certain percentage of the radiation forming part of the curtain half 4*a* and an identical percentage of radiation forming part of the curtain half 4*b*. The testing or monitoring operation is just as satisfactory if the advancing packet 2 does not move forwardly in a manner as shown in the left-hand portion of FIG. 2, namely between two guide rails 5*a*, 5*b* which compel successive packets to approach the monitoring station between the radiation sources 6*a*, 6*b* and the receivers 7*a*, 7*b* in an orientation in which its underside extends beyond the marginal portions of the upper reach of the conveyor 3 to the same extent. Thus, and as can be seen in FIG. 5*b*, a satisfactory packet 2 which is being tested for the acceptability or lack of acceptability of its outline can intercept a larger percentage of radiation forming the curtain 4*b* and a smaller percentage of radiation forming the curtain 4*a*, as long as the total amount of radiation impinging upon the receivers 7*a*, 7*b* is indicative of testing of a packet 2 having an acceptable outline.

Figure 6A:
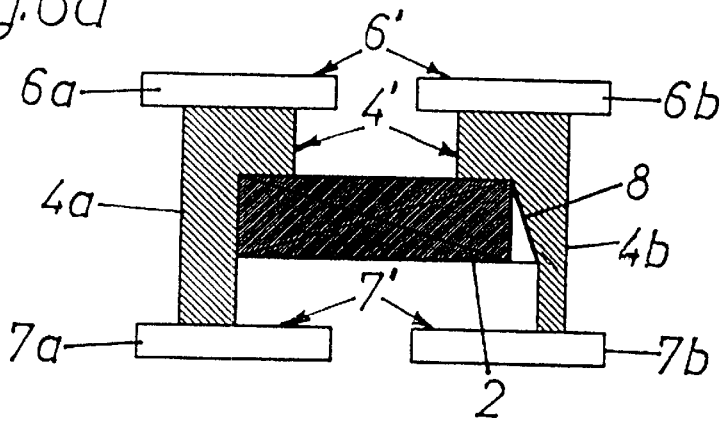
FIG. 6*a* is a view identical to that of FIG. 5*a* but showing a commodity having an unsatisfactory outline in the process of intercepting portions of the two curtains of radiation issuing from the two discrete overhead radiation sources.
Figure 6B:
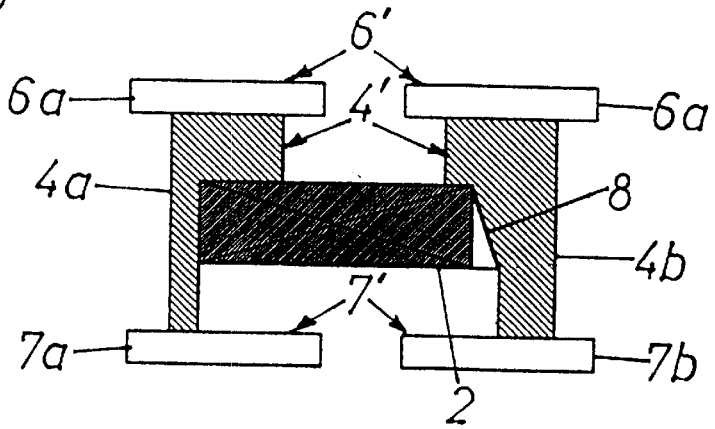
FIG. 6*b* shows the structure of FIG. 6*a* but with the defective commodity in a position laterally offset relative to the position of such commodity in FIG. 6*a;*
Figure 7:
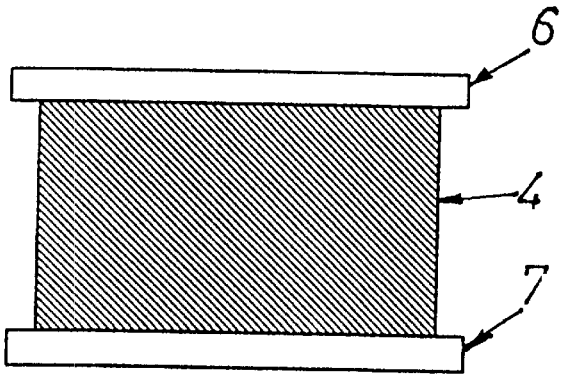
FIG. 7 is a view similar to that of FIGS. 3, 5*a*, 5*b*, 6*a* or 6*b* but showing a one-piece source which establishes a one-piece curtain of radiation extending across the path of successive commodities to be tested into the range of a single receiver of radiation.
Figure 8:
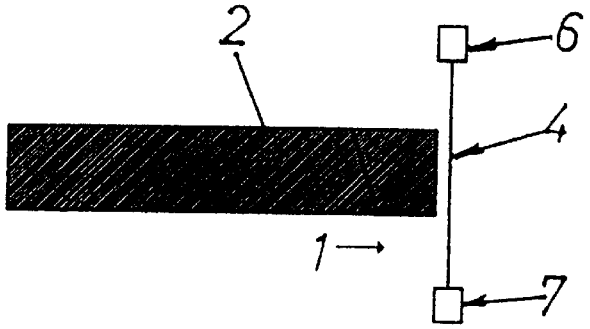
FIG. 8 shows the structure of FIG. 7 in a view similar to that of FIG. 4 and further illustrates a satisfactory block-shaped commodity on its way toward the one-piece curtain of radiation.
Figure 9A:
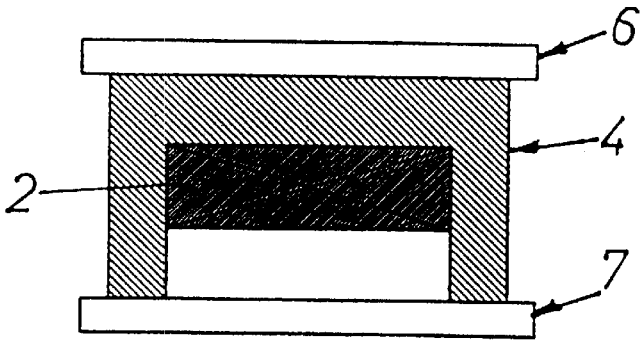
FIG. 9*a* is a view similar to that of FIG. 5*a* and shows the satisfactory commodity of FIG. 8 in the process of intercepting that amount of radiation which is expected to be intercepted by a prototype commodity having an ideal or optimal outline.
Figure 9B:
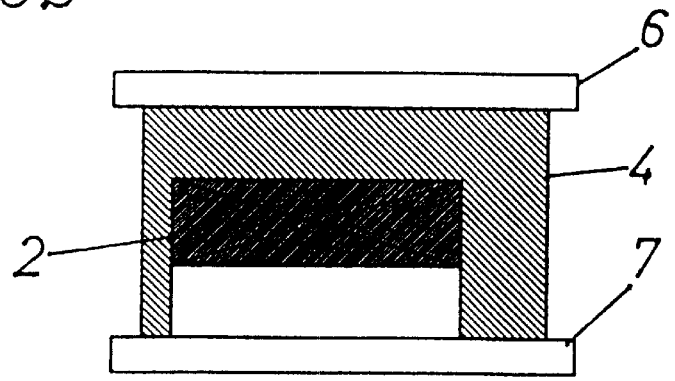
FIG. 9*b* is a view identical to that of FIG. 9*a* but with the satisfactory commodity laterally offset relative to the commodity which is illustrated in FIG. 9*a;*
Figure 10A:
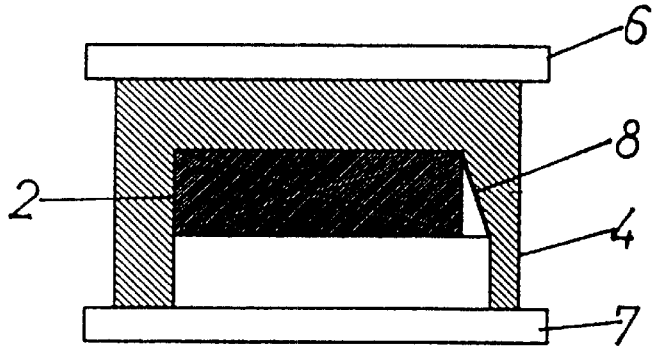
FIG. 10*a* is a view identical to that of FIG. 9*a* or 9*b* but showing a commodity having an unsatisfactory lateral outline, the commodity being on its way across the one-piece curtain of radiation.
Figure 10B:
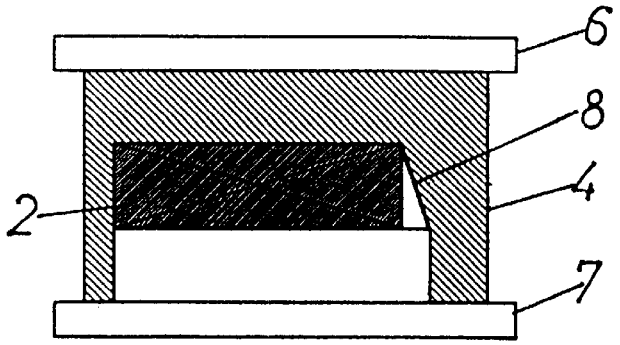
FIG. 10*b* is a view identical with that of FIG. 10*a* but with the defective commodity laterally offset relative to the defective commodity which is shown in FIG. 10*a*.

Analogously, and as shown in FIGS. 6*a* and 6*b*, a packet 2 having-an unsatisfactory outline can be reliably detected regardless of whether it arrives at the testing station in a centered position as determined by the guide rails 5*a*, 5*b* (see FIG. 6*a*) or in a laterally offset position (see FIG. 6*b*). The presence of a packet 2 having a defective outline is ascertained by the composite receiver 7' whenever its sections 7*a*, 7*b* indicate that the combined amount of radiation intercepted by the defective or unacceptable packet 2 is outside of a preselected range denoting a packet having an acceptable outline (as seen in a direction from the composite radiation source 6' downwardly toward the upper reach of the conveyor 3 and the composite receiver 7').

The packet 2 which is shown in FIGS. 6*a* and 6*b* has an outline which is deemed to be unsatisfactory because one lateral flap 8 of its outer envelope is not glued or otherwise secured to the adjacent panel or wall of such envelope. Therefore, the total amount of radiation intercepted by such unacceptable packet exceeds the upper limit of the range of acceptable amounts of intercepted radiations. A comparison of FIG. 5*a* with FIG. 6*a* or of FIG. 5*b* with FIG. 6*b* shows that the quantity of radiation intercepted by a packet 2 having a loose and outwardly extending flap 8 (i.e., a flap which does not lie flush against the adjacent panel of the outer or outermost envelope of such packet) considerably exceeds the amount of radiation which is intercepted by an acceptable packet of the type shown in FIGS. 5*a* and 5*b*.

FIG. 2 shows that the width of a packet 2 exceeds the width of the path defined by the upper reach of the conveyor 3. On the other hand, the width of a packet 2 is less than the width of a one-piece curtain 4 (see FIGS. 9*a*, 9*b*, 10*a* and 10*b*) but exceeds the width of the gap between two coplanar curtains 4*a*, 4*b* (see FIGS. 5*a*, 5*b*, 6*a* and 6*b*). Therefore, even if a packet 2 having an unsatisfactory outline is being advanced to the left or to the right of its optimal path (the packet 2 of FIG. 6*a* advances along such optimal path and the packet of FIG. 6*b* advances to the left of its optimal path), the improved apparatus is still capable of detecting the packets having unacceptable outlines because the receiver 7' generates signals denoting the sums of radiation intercepted by an unsatisfactory packet advancing in a manner as shown in FIG. 6*a* or in FIG. 6*b*.

In fact, the width of the single (one-piece) curtain 4 or the combined width of the two discrete narrower curtains 4*a*, 4*b* (plus the width of the gap between the curtains 4*a*, 4*b*) is preferably selected in such a way that the apparatus can properly test commodities having a width greater than that of the illustrated packets 2 but less than the width of the curtain 4 or the combined width of the curtains 4*a*, 4*b* plus the width of the gap between them. On the other hand, if the commodities are to be tested in an apparatus utilizing the composite sender 6', the width of such commodities must exceed the width of the gap between the curtains 4*a*, 4*b*. Thus, the improved apparatus can be utilized for reliable determination of the outlines of a wide variety of commodities without it being necessary to replace the sender 6 or 6' and/or the receiver 7 or 7'.

Still further, the improved apparatus can be utilized to monitor commodities wherein the outer layers or panels or sheets exhibit different reflectivities. All that is necessary is to properly set or adjust the components of the control means which receive signals from the receiver 7 or 7' and process such signals, preferrably for the purpose of segregating commodities (such as packets 2) having unsatisfactory outlines from commodities having acceptable outlines. The signals which are generated and processed in the apparatus of FIGS. 1 and 2 (with the sender 6 or 6' and receiver 7 or 7') are electric signals.

The electric signals which are generated by the receiver 7 or 7' and are indicative of packets 2 having satisfactory outlines (see FIGS. 5*a*, 5*b*, 9*a* and 9*b*) are transmitted via conductor means 14 to one input of a control circuit 16 which has another input receiving signals, via conductor means 13, from a source 12 of electric reference signals denoting the interruption of radiation by a prototype commodity (such as the packet 2 shown in FIGS. 5*a*, 5*b*, 9*a* or 9*b*). The circuit 16 compares the reference signal with successive (first) signals transmitted via conductor 14 and, if the difference between the intensity or another characteristic of the reference signal and a first signal is outside of a range of acceptable differences, the output of the circuit 16 transmits a signal, via conductor means 17, to a suitable ejector 9 which segregates the corresponding (defective) packet 2 (i.e., a packet having an unsatisfactory outline as shown in FIGS. 6*a*, 6*b*, 10*a* or 10*b*) from the packets having satisfactory outlines. To this end, the illustrated ejector 9 comprises a nozzle 11 which receives a pressurized fluid (such as compressed air) from a suitable source (not specifically shown) and is positioned to expel a packet of the type shown in FIGS. 6*a*, 6*b*, 10*a* and 10*b* from the path defined by the upper reach of the conveyor 3 into a collecting receptacle or onto a take-off conveyor, not shown. For example, the ejector 9 can comprise a normally closed valve which opens for a fixed interval of time in response to a signal transmitted by the conductor means 17.

The circuit 16 can be set up to initiate the transmission of a signal via conductor means 17 only when the intensity of a first signal transmitted from the receiver 7 or 7' via conductor means 14 exceeds an upper threshold or is below a lower threshold of a range of intensities of the reference signal or signals transmitted by the source 12 via conductor means 13. The source 12 of reference signals can be incorporated into the control circuit 16, or the circuit 16 and the source 12 can be incorporated into the receiver 7 or 7'.

The method and apparatus of the present invention can be resorted to with particular advantage to ascertain the presence or absence of flaps or like projections which might extend from packets of smokers' products advancing from a packing machine to the next processing station, for example, from a packer known as COMPAS 500 to a film wrapper known as C 90, or from such film wrapper to a pack boxer known as B 90. The just mentioned machines are distributed by the assignee of the present application.

An advantage of the embodiment which employs a radiation source 6 and a receiver 7 of the type shown in FIGS. 7 to 10*b* is its simplicity. Thus, the receiver 7 need not generate (first) signals denoting the sum of radiations intercepted by a satisfactory or unsatisfactory packet 2 in a manner as shown in FIGS. 3 to 6*b*, i.e., by two discrete sections 7*a*, 7*b* of a composite receiver 7'.

On the other hand, the apparatus which employs the composite source 6' of radiation and the composite receiver 7' exhibits the advantage that the source 6' need not emit (wasted) radiation above the upper reach of the conveyor 3, i.e., in the region where the conveyor 3 prevents radiation from reaching the receiver 7'. FIG. 2 shows that the sections 6*a*, 6*b* of the composite source 6' are outwardly adjacent the respective marginal portions of the conveyor 3.

The fluid-operated ejector 9 can be replaced with other suitable (e.g., mechanical) removing means.

Even though the improved apparatus can employ or can cooperate with a rotary wheel-shaped conveyor (not shown), it is presently preferred to employ a conveyor (such as the endless belt, band or chain conveyor 3 of FIGS. 1 and 2) which defines for successive packets 2 a straight (linear) horizontal path, and to employ one or more radiation sources 6 or 6' each arranged to furnish a vertical or substantially vertical (composite or one-piece) curtain of suitable radiation in a direction toward a single (7) or composite (7') receiver of radiation.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of monitoring the outlines of cigarette packets and other types of containers and, therefore, such adaptations should and are intended to be comprehended within the meaning and range of equivalence of the appended claims.

What is claimed is:

1. A method of ascertaining the presence and absence of departures of the outlines of successive commodities from a predetermined outline, comprising the steps of:

advancing successive commodities along a predetermined path;

establishing at least one curtain of radiation across a predetermined portion of the path so that successive commodities advancing along said portion of the path intercept amounts of radiation commensurate with their outlines; and removing from the path each commodity which intercepts an amount of radiation departing from a predetermined amount indicative of said predetermined outline.

2. The method of claim 1, wherein the commodities are containers.

3. The method of claim 1, wherein the commodities are packets containing smokers' products.

4. The method of claim 1, wherein said removing step includes generating first electric signals denoting the amounts of radiation intercepted by successive commodities during advancement along said portion of the path, generating a reference signal denoting the amount of radiation intercepted by a commodity having said predetermined outline, and comparing each first signal with the reference signal.

5. The method of claim 1, wherein said establishing step includes establishing a single curtain.

6. The method of claim 1, wherein said establishing step includes establishing a plurality of discrete curtains.

7. The method of claim 6, wherein each of said discrete curtains extends across said portion of the path in a position such that it is at least partially intercepted by successive commodities having said predetermined outline.

8. The method of claim 1, wherein said advancing step includes moving successive commodities along an at least substantially horizontal path.

9. The method of claim 8, wherein said at least one curtain is located in an at least substantially vertical plane crossing said predetermined portion of the path.

10. The method of claim 1, wherein the commodities are containers having portions assuming first positions when the outlines of the commodities at least approximate said predetermined outline and assuming second positions when the outlines of the commodities depart from said predetermined outline.

11. The method of claim 1, further comprising the steps of ascertaining the amounts of radiation intercepted by successive commodities in said portion of the path, generating first signals denoting the intercepted amounts of radiation, and comparing said first signals with a reference signal denoting said predetermined amount of radiation, said removing step including diverting from the path those commodities which, during advancement along said portion of the path, initiate the generation of first signals departing from said reference signal.

12. The method of claim 11, wherein said establishing step includes establishing a plurality of discrete curtains each extending across said portion of the path in a position such that it is at least partially intercepted by successive commodities having an outline at least approximating said predetermined outline, each of said first signals denoting the sum of radiations intercepted by the respective commodities advancing along said portion of the path.

13. An apparatus for ascertaining the presence and absence of departures of the outlines of successive commodities from a predetermined outline, comprising:

means for advancing successive commodities along a predetermined path;

means for establishing at least one curtain of radiation across a predetermined portion of said path so that successive commodities advancing along said portion of said path intercept amounts of radiation commensurate with their outlines; and means for comparing the intercepted amounts of radiation with a predetermined amount denoting the amount intercepted by a prototype commodity having an outline at least approximating said predetermined outline.

14. The apparatus of claim 13, wherein said means for establishing at least one curtain of radiation comprises at least one source of radiation at one side of said portion of said path and said means for comparing comprises at least one receiver of radiation at another side of said portion of said path at least substantially opposite said one side.

15. The apparatus of claim 13, wherein said means for comparing comprises means for generating successive first signals having characteristics denoting the amounts of radiation intercepted by successive commodities advancing along said portion of said path, means for establishing and maintaining a reference signal having characteristics indicative of the amount of radiation intercepted by said prototype commodity, and means for generating third signals denoting differences between successive first signals and said reference signal, and further comprising means for removing from said path those commodities which initiate the generation of third signals denoting differences outside of a predetermined range of differences.

16. The apparatus of claim 15, wherein said signals are electric signals.

17. The apparatus of claim 13, wherein said means for establishing includes a single source arranged to emit a single curtain of radiation.

18. The apparatus of claim 17, wherein said path has a predetermined width and said single curtain has a width at least matching said predetermined width.

19. The apparatus of claim 18, wherein the prototype commodity has a width less than the width of said single curtain.

20. The apparatus of claim 13, wherein said means for establishing includes a plurality of sources disposed at one side of said portion of said path and arranged to establish discrete parallel curtains of radiation, and a plurality of receivers of radiation, one for each of said sources, disposed at another side of said portion of said path opposite said one side.

21. The apparatus of claim 20, wherein said path is an at least substantially horizontal linear path, said sources being disposed at a level above said portion of said path and said receivers being disposed beneath said portion of said path.

* * * * *